United States Patent [19]

Krueger

[11] 4,190,241

[45] Feb. 26, 1980

[54] APPARATUS FOR CONVERTING PAPER ROLLS INTO STACKS OF INDIVIDUAL FOLDED PAPER SHEETS

[75] Inventor: Gary A. Krueger, Neehah, Wis.

[73] Assignee: Kimberly-Clark Corporation, Neehah, Wis.

[21] Appl. No.: 901,436

[22] Filed: May 1, 1978

[51] Int. Cl.[2] ..... B42C 1/04

[52] U.S. Cl. ..... 270/47; 270/42; 270/60

[58] Field of Search ..... 270/60, 42, 47, 48, 270/6, 13, 19; 93/93 R, 93 M, 93 C, 93 D, 93 K, 93 DP

[56] References Cited

U.S. PATENT DOCUMENTS

| | | | |
|---|---|---|---|
| 3,203,326 | 8/1965 | Obenshain | 270/60 |
| 3,614,087 | 10/1971 | Zernov | 270/60 |

*Primary Examiner*—Edgar S. Burr
*Assistant Examiner*—A. Heinz
*Attorney, Agent, or Firm*—Leydig, Voit, Osann, Mayer & Holt, Ltd.

[57] ABSTRACT

An apparatus for converting rolls of paper web into stacks of folded sheets on a continuous high speed basis includes slitting a supply roll into plural narrow webs, folding the narrow webs longitudinally, cutting the folded webs transversely into sheets of suitable length, pre-stacking continuous streams of adjacent folded sheets emerging from the cutters before they are carried to a final stacking mechanism. The pre-stacking mechanism removes certain sheets from their original positions in the continuous streams of folded sheets and places them on top of other sheets in the streams from which they were removed in order to deliver to the final stacking mechanism sets of pre-stacked sheets with a gap between adjacent sets.

4 Claims, 20 Drawing Figures

APPARATUS FOR CONVERTING PAPER ROLLS INTO STACKS OF INDIVIDUAL FOLDED PAPER SHEETS

BACKGROUND OF THE INVENTION

This invention relates generally to paper converting processes and machinery, and more particularly to a machine for converting tissue rolls into folded tissue sheets and for producing individual stacks of tissue sheets that are ready for packaging in cartons.

It is generally recognized that the rate of operation attainable by the stacking and packing mechanism at the output end of a converting machine, imposes a critical limitation on the rate of operation attainable by the overall machine, because the typical stacking mechanism requires more return time between successive operations than is required at other stations in the machine. For example, in machines used for converting tissue rolls into folded tissue napkins, a high-speed stacking mechanism may be used which involves cyclic motion of a set of stacker fingers to remove from a transfer roll napkins delivered by the roll to the stacking mechanism. In such a napkin machine, the overall machine rate is limited by the attainable rate of the stacking mechanism, which is substantially slower than speeds attainable with rotary cutting and folding mechanisms which also may be utilized in such machines.

SUMMARY OF THE INVENTION

The principal object and aim of the present invention is to provide a machine for converting tissue rolls into individual stacks of folded tissue sheets which operates to deliver and stack folded sheets at about twice the cyclic rate of the final stacking mechanism.

Another general object of the invention is to increase the effective rate of operation of conventional stacking mechanisms, by providing a pre-stacking mechanism for delivering sets of sheets to the stacking mechanism, so that the mechanism is operated at each cycle to stack a plurality of sheets rather than a single sheet.

A further object of this invention is to provide a tissue converting machine with stations for (1) slitting the wide tissue web from a tissue supply roll into plural narrow webs, (2) folding the narrow webs longitudinally, and (3) cutting the folded web transversely into lengths suitable for use as facial tissue, so that such folded tissues are provided at a high speed in a continuous stream and adjacent one another, the stations having mechanisms for carrying out the requisite functions at such stations at extremely high speed.

A more detailed object of this invention is to provide such a converting machine in which a continuous stream of adjacent folded sheets emerges from a cutting station, with means for pre-stacking the sheets before delivery to the stacking mechanism, so that spaced sets of pre-stacked sheets are delivered to the stacking mechanism. A related object is to provide a pre-stacking means for such a converting machine in which a continuous stream of adjacent folded sheets is processed before it is delivered to the final stacking mechanism by removing certain sheets from the stream, returning the removed sheets and placing them on top of sheets remaining in the stream, thereby forming sets of pre-stacked sheets spaced by the gap vacated by the removed sheets. The gaps between sets of sheets provide an interval for the stacking mechanism to move one set of sheets onto the top of the stack before the next set of sheets arrive.

DETAILED DESCRIPTION OF THE PREFERRED EMBODIMENT

Figure 1:
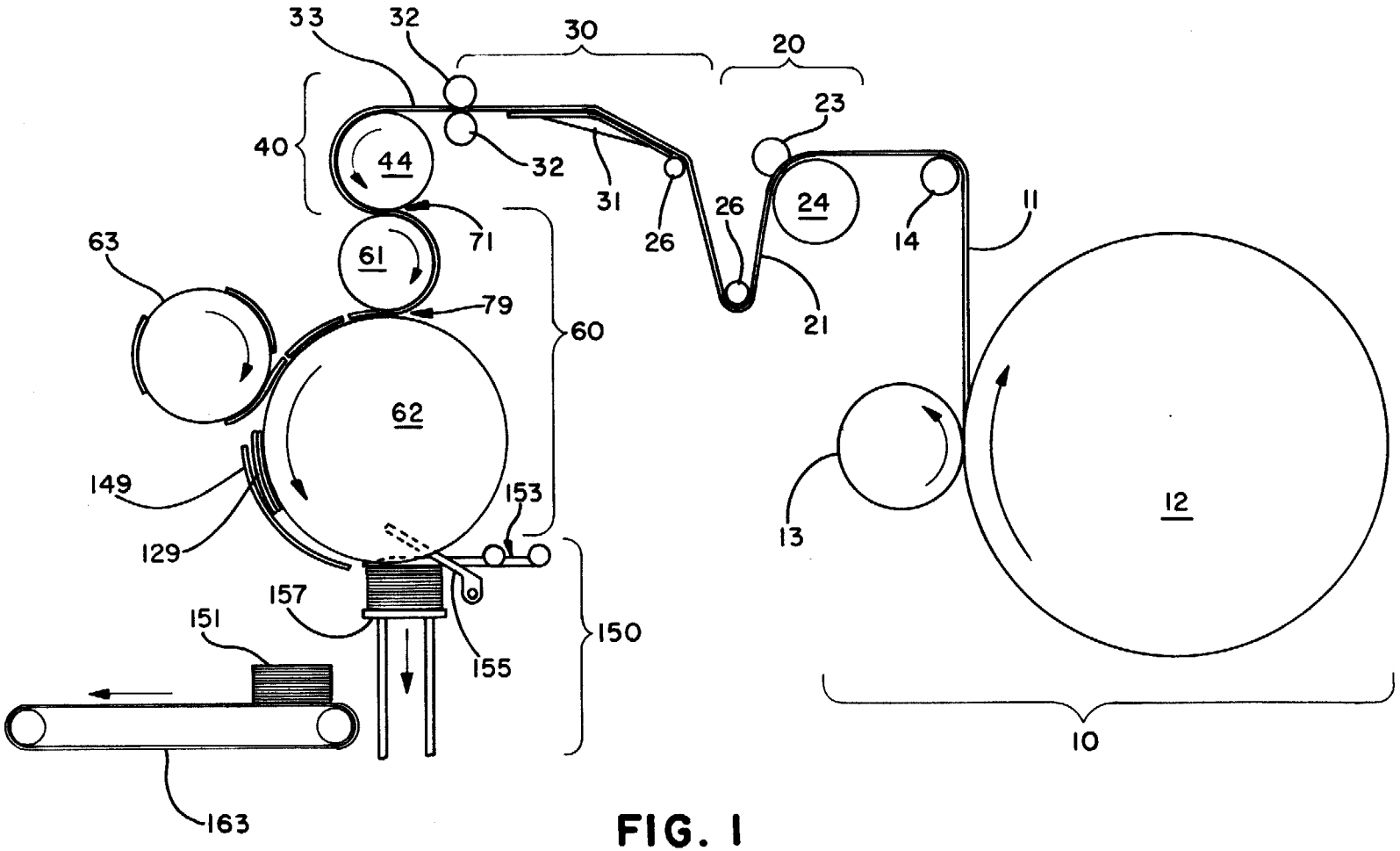
FIG. 1 is a diagrammatic illustration of a high speed machine for converting a supply roll of tissue into individual folded tissue sheets and for stacking the sheets in accordance with the present invention.

Briefly, the machine shown for purposes of illustration in the drawings is capable of converting a tissue supply roll into individual tissue sheets and stacking the sheets on a continuous, high speed production basis (i.e. on the order of at least 900 sheets/stack/minute). Referring to FIG. 1, the machine in general comprises a main web feeding station 10, a slitting station 20, a folding station 30, a cutting station 40, a transfer and pre-stacking station 60, and a final stacking station 150.

MAIN WEB FEEDING STATION

At the main web feeding station 10 of the illustrative machine a main web of tissue 11 is fed into the machine from a supply roll 12 that is rotated in the unwind direction by maintaining the supply roll in contact with an unwind drum 13 that is rotated in the opposite direction. As illustrated, the main web passes over a guide roll 14 before it arrives at the slitting station 20. The guide roll 14 positions the main web properly for the slitting operation.

SLITTING STATION

At the slitting station 20, the main web 11, which is the full width of the supply roll 12, is slit into multiple (typically six to fifteen) narrow webs 21 of uniform width. The slitter in the illustrative machine is a scoretype slitter, and it includes a plurality of spaced circular knives 23 having v-shaped cutting edges. The knives are driven by contact with an anvil roll 24 over which the web travels. To assure that the narrower webs cut from the edges of the main web are of the desired uniform width, a narrow strip of waste web 25 can be slit from each edge of the main web.

In the illustrative machine, the narrower webs 21 are shown passing over a plurality of rolls 26 downstream of the slitting station 20, which rolls position the narrow webs properly for the folding operation.

FOLDING STATION

At the folding station 30, each of the narrow webs 21 is folded longitudinally. This is accomplished as the webs travel over folding boards 31, one folding board being provided for each of the narrow webs.

The narrow webs 21 are each maintained at the proper tension as they pass over and away from the folding boards 31 by sets of feed rolls 32 mounted downstream from the folding boards. A set of feed rolls is provided for each folded web 33. Each set of feed rolls preferably consists of two steel rolls of equal diameter having knurled surfaces with an adjustable gap therebetween. The surface speed of the feed rolls 32 can be controlled by a variable speed drive, making the feed roll speed adjustable relative to the web speed. Adjustment of the gap between rolls in a set in conjunction with adjustment of the relative speeds of the web and feed rolls provide means for adjusting web tension. This adjustment also controls tension of each folded web as it enters the cutting station 40.

CUTTING STATION

At the cutting station 40, each folded web 33 is transversely segmented into a series of adjacent sheets. The segmenting operation is carried out simultaneously on all of the folded webs. In the illustrative machine, a cutter mechanism, including a rigid carbide anvil 42 and a set of resilient cutting knives 43, is provided for each folded web (see FIG. 3).

Figure 2:
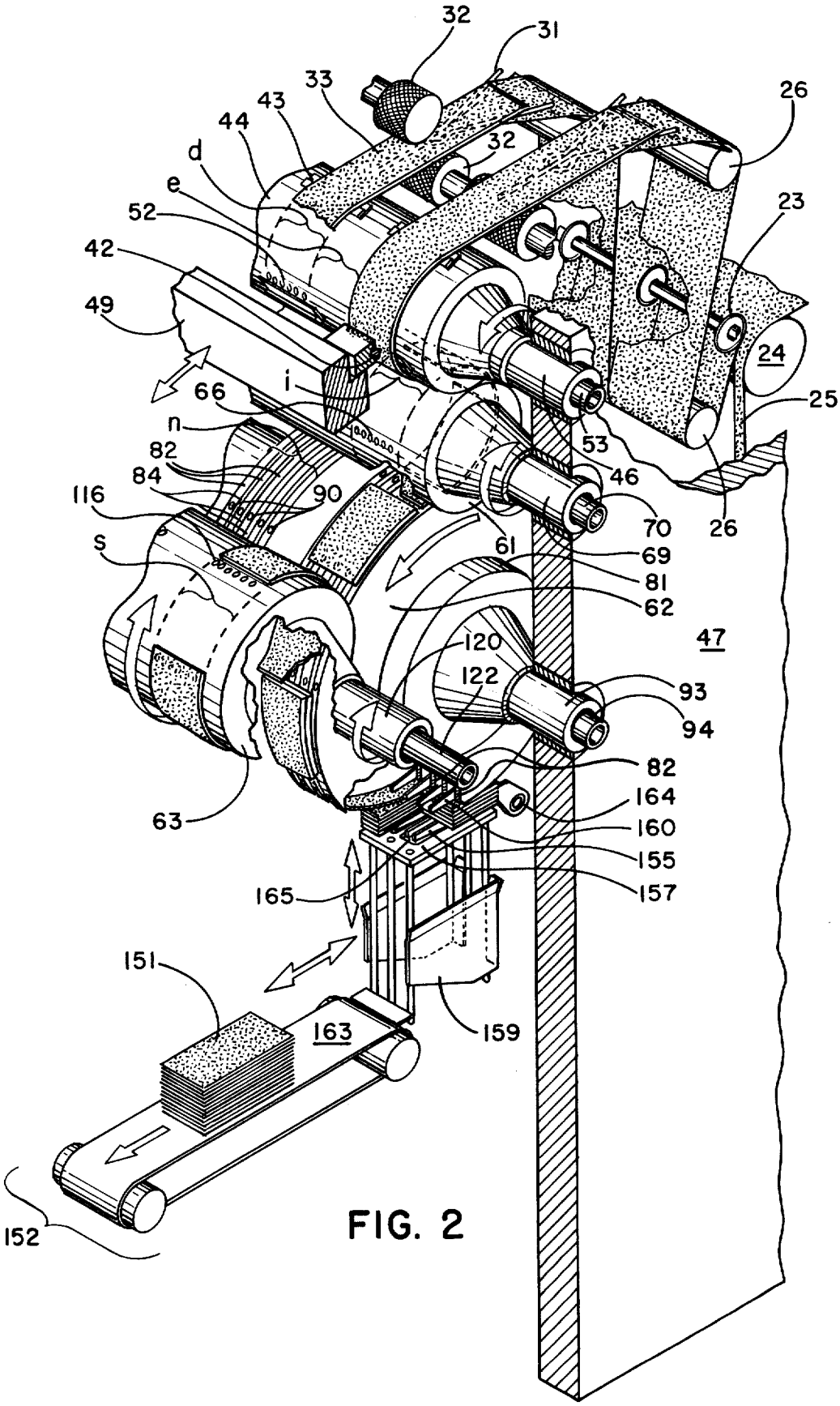
FIG. 2 is a fragmentary perspective view of portions of the machine shown in FIG. 1, illustrating portions of the slitting, folding, cutting, pre-stacking, and stacking mechanisms.
Figure 3:
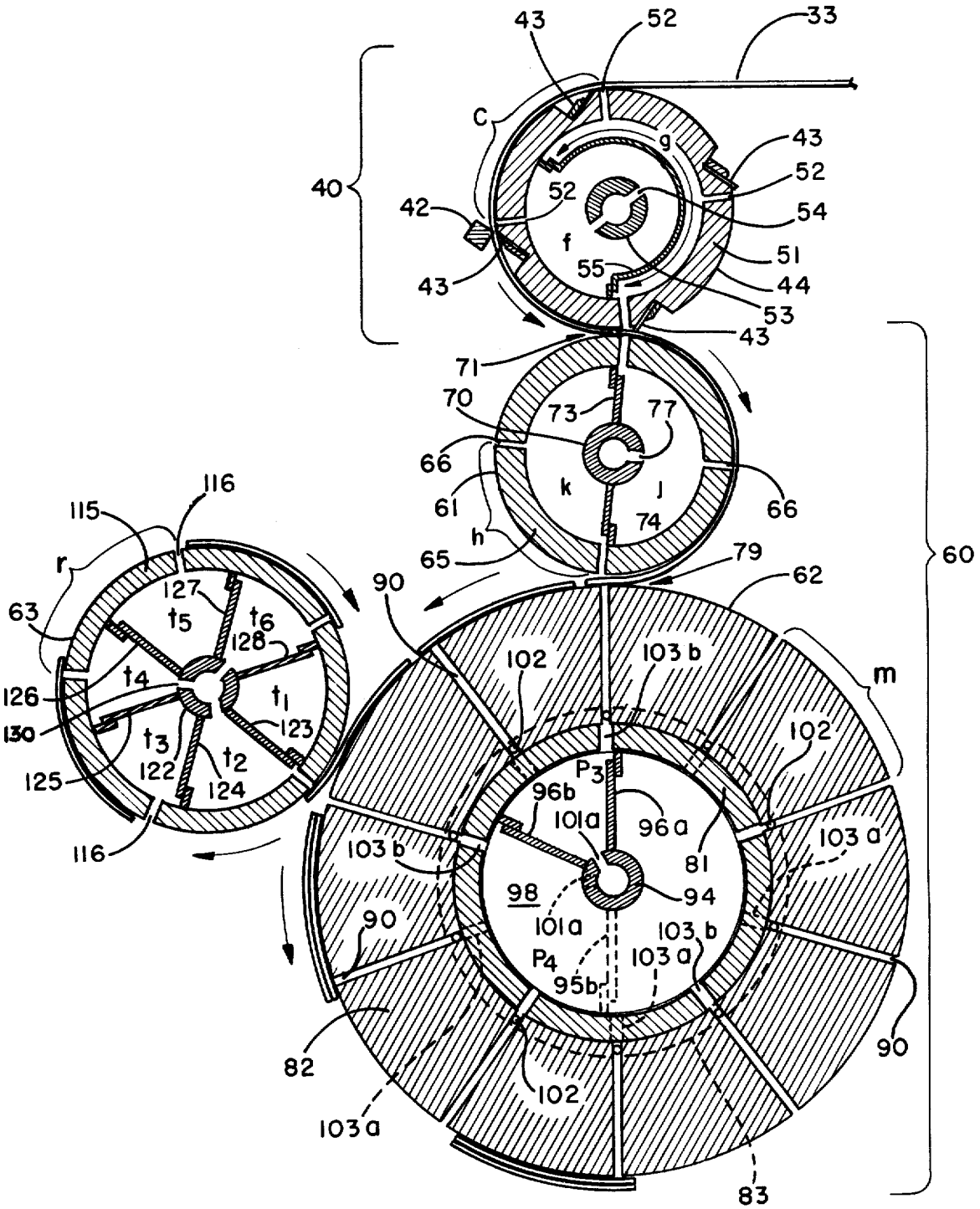
FIG. 3 is an enlarged diagrammatic illustration of the cutting, first transfer, second transfer, and pre-stacking cylinders of the machine shown in FIG. 1.

As shown in FIG. 3, the cutting knives 43 are mounted in the cylindrical shell of a common knife-cylinder 44. Each blade is mounted in the shell with the plane of the blade being parallel to the axis of the cylinder and at 45° to a plane that is tangent to the knife cylinder at the blade. The cutting edges of blades extend slightly beyond the shell of the knife-cylinder. The knives in a given set are mounted with regular circumferential interval c between them in a band d around the knife cylinder. The knife cylinder is supported for rotation on a hollow shaft 46 journaled in the assembly frame 47 (see FIG. 2). The regular interval c separating the knives 43 corresponds to the desired sheet length, on the order typically of 9 ¼". The circumference of the knife cylinder 44 is proportioned to equal an integral number of these intervals. The bands d are axially spaced from each other along the cylinder 44 by intervals e.

The anvils 42 are held by a stationary member 49 in a row adjacent to the knife cylinder 44. Each anvil is held opposite a band d containing a set of knives 43. The cutting edge of each anvil lies in a plane that is parallel to and slightly removed from a plane tangent to the knife cylinder, but the cutting edges are inclined relative to the cylinder's axis. This orientation is adopted to provide shearing action between the anvils and the respective sets of knives. As the knife cylinder rotates, point contact between anvil and blade is established, and this point of interference traverses the folded web as the cylinder continues to rotate. The cutting edges of the resilient knives are ground slightly concave to compensate for the incline of the rigid anvils.

To carry the individual sheets through the cutting station and keep them adjacent and in-stream as they travel, the knife cylinder 44 includes means for holding at least the leading edge of each sheet in place against the knife-cylinder until the sheet is transfered from the knife cylinder.

As shown in the illustrative embodiment, and referring particularly to FIGS. 2 and 3, the knife cylinder 44 has a cylindrical shell 51, and the sheet holding means comprises rows of suction ports 52 that penetrate the shell immediately behind each of the knives. Thus, if the knives are placed 9¼" apart, the rows of suction ports 52 are also spaced 9¼" apart. To supply the suction ports with vacuum, a supply shaft 53 having passages 54 that communicate with the interior of the knife cylinder and connect it to a vacuum supply, passes into the cylinder through the hollow shaft 46 that supports the cylinder. The supply of vacuum to given rows of ports is regulated by a stationary curved vane 55 that passes axially through the interior of the knife cylinder. The vane is in substantial sealing engagement with the shell and divides the interior radially into a sector f where vacuum is supplied and a sector g where vacuum is not supplied. The curved vane is mounted on discs, which are in turn mounted perpendicular to the stationary vacuum supply shaft 53 at the ends of the cylinder 44.

TRANSFER AND PRE-STACKING STATION

At the transfer and pre-stacking station 60, each stream of adjacent sheets coming from the cutting station 40 is carried therefrom, and the sheets in the streams are transferred downstream for stacking. In accordance with the present invention, at this station certain sheets are taken from each stream and placed on top of other sheets in the same stream from which they were removed, so that sets of pre-stacked sheets, spaced by the gaps vacated by the removed sheets, are delivered to the stacking station 150. The transfer and pre-stacking operations are carried out simultaneously for each stream of sheets.

In the illustrative machine, the transfer and pre-stacker station 60 comprises three rotary cylinders, including:

(1) a first rotary transfer cylinder 61 for receiving sheets from the knife cylinder 44;

(2) a second rotary transfer cylinder 62 for receiving sheets from the first transfer cylinder 61 and carrying the sheets to the stacking station 150; and (3) a rotary pre-stacker cylinder 63, which, in accordance with the invention, pre-stacks sheets in the streams of sheets carried by the second rotary transfer cylinder 62.

As shown in FIG. 3, the first rotary transfer cylinder 61 is positioned adjacent and tangent to the knife cylinder at the knife cylinder's 6 o'clock position. To remove sheets from the knife cylinder and keep them adjacent and in-stream as they are being carried to the second rotary transfer cylinder 62, the first rotary transfer cylinder 61 includes means for holding at least the leading edge of each sheet in place against the first rotary transfer cylinder while the sheet is carried thereon. In the illustrative machine, the first rotary transfer cylinder 61 has a cylindrical shell 65, and the sheet holding means comprises rows of suction ports 66 that penetrate the shell. Each row is parallel to the cylinder axis, and the rows are positioned with a regular circumferential interval h between them, in bands i around the cylinder 61. The bands i correspond to the working surface of the cylinder 61. Because the first rotary transfer cylinder 61 is rotated at the same circumferential speed as the knife cyliner 44, the circumferential interval h between suction ports on the first transfer cylinder should be identical to the interval c between rows of ports on the knife cylinder, i.e., the intervals should both be equal to the sheet length. The circumference of the first transfer cylinder is proportioned to equal an integral number of these intervals.

The shell 65 of the first rotary transfer cylinder 61 is carried for rotation on a hollow shaft 69 journaled in the assembly frame 47 (see FIG. 2). To supply the suction ports 66 in the first transfer cylinder with vacuum, a stationary vacuum supply shaft 70 passes into the cylinder through the hollow shaft 69 that supports the cylinder 61.

As illustrated, and referring specifically to FIG. 3, the sheets traveling on the rotary knife cylinder 44 are released therefrom just before their leading edges reach the nip 71 between the knife cylinder and the first rotary transfer cylinder 61, because the rows of suction ports on the knife cylinder pass from over the internal sector f where vacuum is supplied to over the sector g where vacuum is not supplied just before the rows reach the nip.

The bands d of suction port rows 52 on the knife cylinder 44 are aligned with the bands i of suction port rows 66 on the first transfer cylinder 61, and the rows are in phase so that as the leading edges of sheets are released from the knife cylinder, rows of suction ports on the first transfer cylinder are ready to grip the leading edges of the sheets, from the other side, and hold them on the first transfer cylinder.

The supply of vacuum to given rows of ports 66 on the first transfer cylinder 61 is regulated by two stationary vanes 73, 74 that are radially attached to the vacuum supply shaft 70 and pass axially through the length of the first transfer cylinder's interior. The vanes are in substantial sealing engagement with the shell and they divide the interior into two sectors: a first sector j, which extends from about the 12 o'clock position to about the 6 o'clock position, (moving clockwise around the circumference of the first transfer cylinder shown in FIG. 3) and a second sector k, which extends from about 6 o'clock back to 12 o'clock. The vacuum supply shaft has passages 77 communicating with the first sector j but not with the latter sector k, so that as the first transfer cylinder rotates, its rows of suction ports are connected to vacuum as they reach the nip 71 with the knife cylinder 44, and are disconnected from the vacuum, after about 180° rotation, just before they reach the nip 79 with the second transfer cylinder 62.

The second rotary transfer cylinder 62 is shown positioned adjacent and tangent to the first transfer cylinder at the latter's 6 o'clock position. To remove sheets from the first transfer cylinder and keep them instream as they are being carried downstream for the pre-stacking and stacking operations, the second rotary transfer cylinder includes means for holding at least the leading edges of sheets in place while they are being carried thereon.

In the illustrative embodiment, (see FIG. 4), the second rotary transfer cylinder 62 has a cylindrical core 81 with a plurality of parallel discs 82 of uniform diameter mounted on the core perpendicular to the axis of the cylinder. The discs 82 include collars 83 that are proportioned to fit around the core 81 and space the discs apart axially along the core. Conveniently, the discs may be ½" thick, with the separation between discs also being ½". The separation between discs provides deep circumferential grooves 84 (see FIG. 2) in the cylinder that provide space for operation of the stacking mechanism. As illustrated in FIG. 2, it is not necessary to provide discs throughout the axial length of the second transfer cylinder, but only at those axial positions along the cylinder that are aligned with the bands of working surface i on the first transfer cylinder. The outside edges of the discs provide the working surface of the second transfer cylinder. A series of five discs 82 with four intervening grooves 84, each ½" in width, provides a band of working surface n that will accommodate a stream of folded tissues that are 4-½" in width.

As shown in the illustrative machine the sheet holding means of the second rotary transfer cylinder 62 includes rows of suction ports 90. Each row is parallel to the axis of the second transfer cylinder; and the rows are positioned with a regular circumferential interval m between them (see FIG. 2) around each band n of the second transfer cyliner's working surface. As illustrated, each row is comprised of five suction ports, including one port in each of the five discs. The circumference of the second transfer cylinder 62 is proportioned to equal an integral number of these intervals m.

The second rotary transfer cylinder 62 is carried for rotation on a hollow shaft 93 that is integral with the cylindrical core 81 and journaled in the assembly frame 47 (see FIG. 2). As shown in FIG. 2, a stationary vacuum supply shaft 94 passes into the closed cylindrical core 81 through the hollow shaft 93 that supports the cylinder.

Delivery of sheets onto the second transfer cylinder 62 from the first transfer cylinder 61 is illustrated in FIG. 3. The sheets traveling on the first rotary transfer cylinder are released when their leading edges reach the nip 79 between the first and second rotary cylinders, because the rows of suction ports 66 on the first transfer cylinder pass from over the internal sector j where vacuum is supplied to over the sector k where vacuum is not supplied just before the rows reach the nip 79.

The bands n of suction port rows on the second transfer cylinder 62 are aligned with the bands i of suction port rows on the first transfer cylinder 61, and the rows are in phase so that rows of ports 90 on the second transfer cylinder will be ready to grip the leading edges of the sheets at the nip 79 between the first and second transfer cylinder when the sheets are released by the first cylinder.

Figure 4:
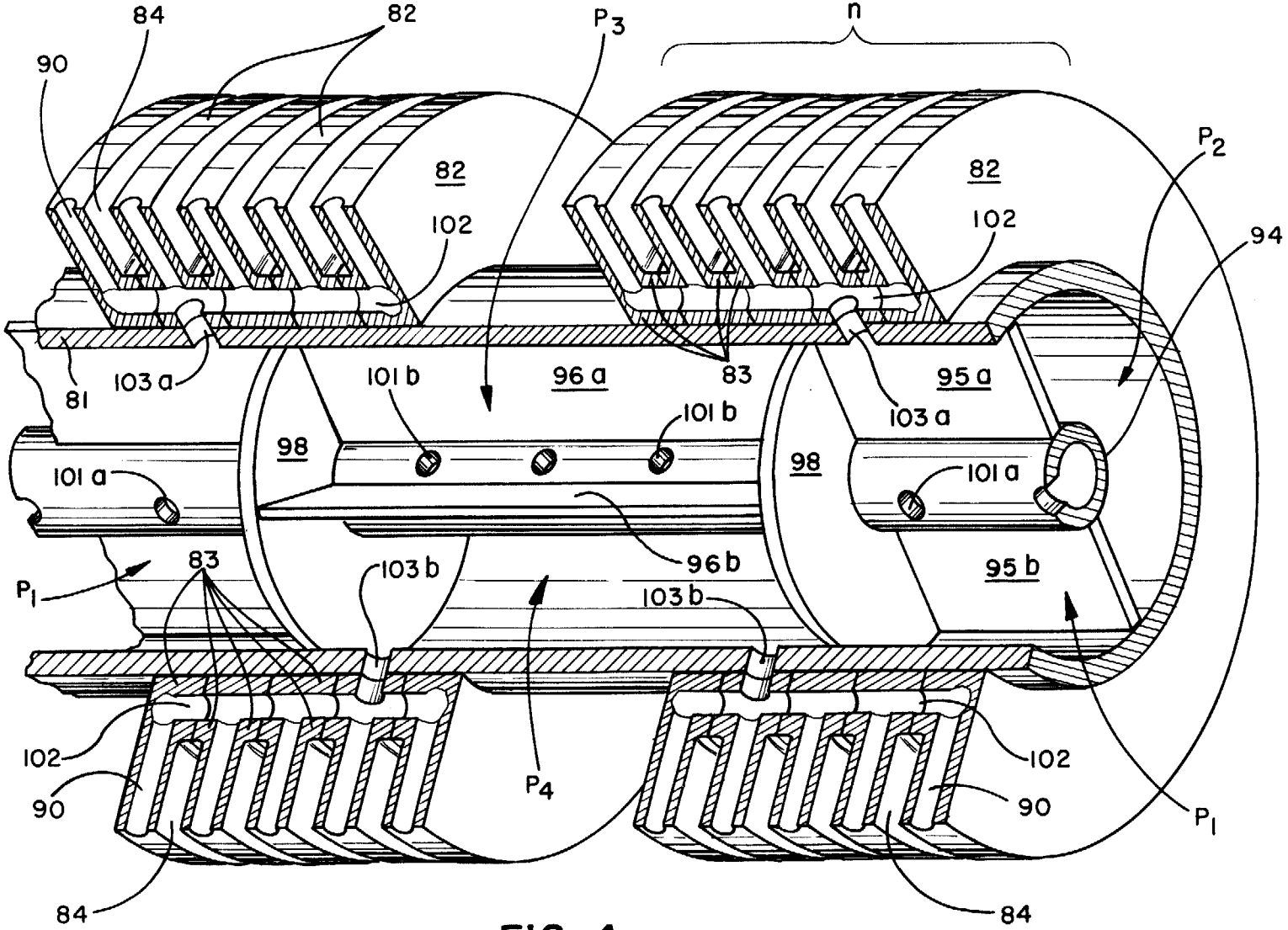
FIG. 4 is a fragmentary perspective view of the second transfer cylinder of the machine shown in FIG. 1, showing the construction of the cylinder and its suction system.

To regulate the vacuum supply to the rows of suction ports 90 on the second transfer cylinder 62, the interior of the cylinder's core 81 is divided axially into a series of segments by a plurality of disc-shaped baffles 98 that are mounted on the vacuum supply shaft 94, perpendicular to the axis of the cylinder, and in substantial sealing engagement with the core (see FIG. 4). The baffles 98 are spaced apart so that for each band n of working surface, a baffle lies approximately in the plane that divides the working surface into two equal halves.

Alternate axial segments within the core 81 are further divided by two stationary vanes 95*a*, 95*b*, that are radially attached to the vacuum supply shaft 94, extend axially from one baffle 98 to the next, and are in substantial sealing engagement with the core 81. In these segments, one of the vanes 95a is positioned at about the 12 o'clock position, and the other vane 95b is positioned at about the 6 o'clock position. (The vantage point in FIG. 4 is from a position at between 10 o'clock and 11 o'clock.) Thus, the two vanes 95a, 95b divide the alternate segments into two chambers p1, p2. (See FIGS. 4–6). The vacuum supply shaft 94 has passages 101a communicating with the p1 chambers, but the vacuum supply shaft does not communicate with the p2 chambers.

The remaining segments within the core 81 are divided by two vanes 96a, 96b that are radially attached to the vacuum supply shaft 94, extend axially from one baffle 98 to the next, and are in substantially sealing engagement with the core. (See FIGS. 4 and 7–10). In these segments, one of the vanes 96a is positioned at about the 12 o'clock position, and the other vane 96b is positioned at about the 10 o'clock position. Thus, the two vanes 96a, 96b divide the remaining alternate segments into two chambers p3, p4. The vacuum supply shaft 94 has passages 101b communicating with the chamber p3 that extends from the 12 o'clock position counterclockwise to about the 10 o'clock position, but vacuum is not connected to the other chamber p4.

Unlike the suction ports on the other cylinders, the suction ports 90 on the second transfer cylinder 62 do not communicate directly with the chambers p1, p2, p3, p4, within the cylinder. Each port 90 passes radially through a disc 82 of the second transfer cylinder to a depth even with the collars of the discs and slightly short of the cylindrical core 81. (See FIG. 4). At this depth, all of suction ports in a row are connected to a perpendicular cross-passage 102. The cross-passages are parallel to the cylinder's axis and pass through the collar portions 83 of the discs 82. Thus, each cross-passage is connected exclusively to the ports of one row. To supply the ports with vacuum, the cross-passages communicate with the chambers within the cylinder through passages 103a, 103b that penetrate radially through the remaining depth of the discs 82 and continue on through the cylindrical core 81. Each row of suction ports 90 communicates with the interior chambers exclusively through one passage.

In a given band n of working surface of the second transfer cylinder, alternate rows of suction ports communicate through passages 103a with the chambers p1, p2, in turn, as the cylinder is rotated. The remaining rows communicate through passages 103b with the chambers p3, p4, in turn, as the cylinder is rotated. The circumference of the second transfer cylinder is therefore proportioned so that there is an even number of rows of ports in the bands n of working surface.

Just before rows of ports 90 on the second transfer cylinder 62 reach the nip 79 with the first transfer cylinder 61, they pass from over sectors p2, p4 where no vacuum is supplied to over sectors p1, p3 where vacuum is supplied, and thus grip the leading edges of the sheets then being released from the first transfer cylinder. (see FIG. 3).

To create a gap between the heretofore adjacent sheets in each stream of folded sheets, the second transfer cylinder 62 is rotated at a slightly greater circumferential speed than the first transfer cylinder 61. Accordingly, the rows of ports 90 in each band n on the second transfer cylinder are separated by a slightly greater circumferential interval m than the interval h of separation on the first transfer cylinder. For instance, if the regular interval is 9 ¼" on the first transfer cylinder, the interval may conveniently be 9 ½" on the second transfer cylinder. The sheets are pulled somewhat across the surface of the first transfer cylinder after they have been gripped by the second transfer cylinder, because the second transfer cylinder is traveling faster. This causes no problem, however, as the tailing edge of the sheet traveling on the first transfer cylinder are not held by that cylinder.

The rotary pre-stacker cylinder 63 is shown positioned adjacent and tangent to the second transfer cylinder 62 at about the 10 o'clock position of the transfer cylinder (referring specifically to FIGS. 3 and 5–10). To remove certain sheets from the second rotary transfer cylinder at the nip 111 between the pre-stacker 63 and second transfer 61 cylinders and keep the removed sheets in-stream and spaced at the same distance that separated the removed sheets when they were carried on the second transfer cylinder, the pre-stacker cylinder includes means for holding at least the leading edge of sheets in place while they are carried on the pre-stacker cylinder.

As shown in the illustrative machine, the rotary pre-stacker cylinder 63 has a cylindrical shell 115, and the sheet holding means comprises rows of suction ports 116 that penetrate the shell at a given circumferential interval r, the rows lying in bands s around the pre-stacked cylinder. The bands s correspond to the working surface of the cylinder 63.

The bands s of working surface on the pre-stacker cylinder 63 are aligned with the bands n of working surface on the second transfer cylinder, and the rows of suction ports on the two cylinders are in phase so that each row of ports 90 on the second transfer cylinder arrives at the nip 111 between the two cylinders at the same time that a corresponding row of ports 116 on the pre-stacker cylinder 63 arrives. The pre-stacker cylinder and the second transfer cylinder rotate in opposite directions but at the same circumferential speed. The interval r between rows of ports 116 on the pre-stacker cylinder 63 is the same as the interval m between rows of ports 90 on the second transfer cylinder 62.

The rotary pre-stacker cylinder 63 is carried for rotation on a hollow shaft 120 that is integral with cylindrical shell 115 (see FIG. 2). A rotatory vacuum supply shaft 122 passes into the cylindrical shell 115 of the cylinder 63 through the hollow shaft 120 which supports the shell.

In the illustrated machine, the pre-stacker cylinder 63 acts as a doubling cylinder, removing alternate sheets from the second transfer cylinder, and placing a sheet on top of every one of the remaining sheets that pass the nip 111 without being removed. To function as a doubling cylinder, the circumference of the pre-stacker cylinder 63 must be proportioned to equal an odd number (N) of regular intervals r—it must have an odd number (N) of rows of ports 116 in each band s around the cylinder 63.

Figure 5:
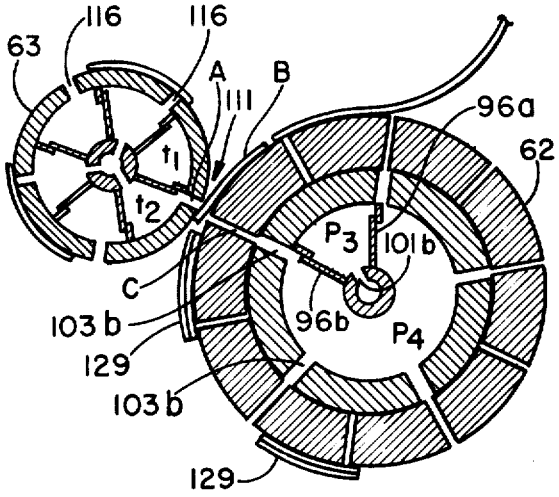
FIGS. 5 and 6 are diagrammatic illustrations of the pre-stacking and second transfer cylinders of the machine shown in FIG. 1, showing the transfer of a typical alternate sheet from the second transfer cylinder to the pre-stacking cylinder and the operation of the suction systems in the cylinders that effect the transfer.
Figure 6:
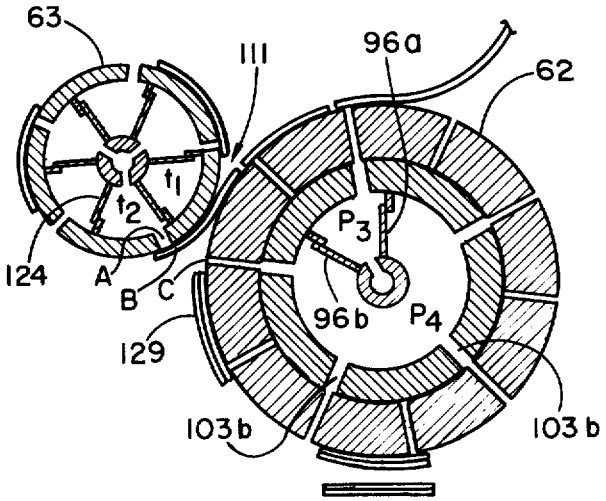

Transfer of certain sheets from the second transfer cylinder 62 to the pre-stacker cylinder 63 is illustrated in FIGS. 5–6.

The hold on the leading edges of alternate sheets traveling on the second rotary transfer cylinder is released when the leading edges reach the nip 111 between the pre-stacker cylinder and the second transfer cylinder, because the rows of suction ports 90 on the second transfer cylinder are disconnected from the vacuum supply as the passages 103b pass from being over the chamber p3 to being over the chamber p4. The hold on the leading edges of the remaining sheets is not released at the nip 111, because the passages 103*a* that supply vacuum to the suction ports holding the sheets remain over a vacuum chamber p1 (see FIGS. 7–10).

As shown in FIG. 3, the supply of vacuum to the rows of ports 116 in the pre-stacker cylinder 63 is regulated by a rotor inside the shell of the pre-stacker cylinder. The rotor is comprised of (1) the rotatory vacuum supply shaft 122 and (2) a plurality of vanes 123, 124, 125, 126, 127, 128 that are radially attached to the rotary shaft, extend axially the length of the pre-stacker cylinder's interior, and are in substantial sealing engagement with the shell 115. Thus, the rotor defines a plurality of chambers t1, t2, t3, t4, t5, t6, within the pre-stacker cylinder, equal in number to the number of vanes. In order to provide alternating vacuum chambers t2, t4, t6 and non-vacuum (air) chambers t1, t2, t3, an even number (N+1) of vanes are used, and the rotary vacuum supply shaft has passages 130 communicating with alternate chambers t2, t4, t6 and not with the others t1, t2, t3. In the illustrated embodiment, six vanes were used, providing six chambers. The rotatory vacuum supply shaft (or rotor shaft) 122, is rotated within the shell 115 of the pre-stacker cylinder 63, in the same direction that the shell rotates, but at a different speed, such that the rotational speed of the shell is greater than the rotational speed of the rotor by the factor (N+1)/N (where N is the odd number of suction ports in the shell and N+1 is the even number of internal chambers). With this construction of the pre-stacker cylinder, the rows of ports 116 in the shell advance from being over a vacuum chamber to being over the successive air chamber in 360° of rotation, and the cylinder is positioned so that the transition occurs just before the ports reach the nip 111 with the second transfer cylinder 62.

Figure 7:
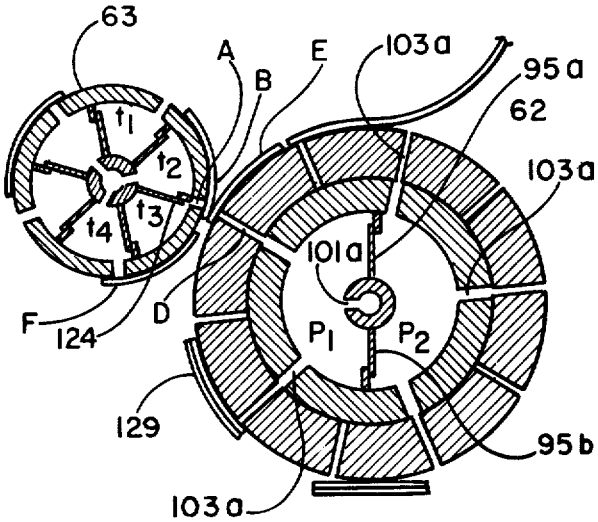
FIGS. 7–10 are diagrammatic illustrations of the pre-stacking and second transfer cylinders of the machine shown in FIG. 1, showing the return of a typical alternate sheet to the second transfer cylinder from the pre-stacking cylinder and the progress of pre-stacked sheets toward the stacking station.

As illustrated in FIG. 5, just before a row A of suction ports on the pre-stacker cylinder 63 reaches the nip 111, a supply of vacuum is provided to the ports, because they pass from being over an air chamber t1 to being over the succeeding vacuum chamber t2. The ports A therefore grip the leading edge of the sheet B that is then entering the nip 111 on the second transfer cylinder. The hold on the leading edge of the sheet B by the row of ports C on the second transfer cylinder is released when the leading edge of the sheet B enters the nip 111, because the passage supplying the row of suction ports C has passed over a chamber p4 that is not supplied with vacuum. Therefore, the sheet B travels from the second transfer cylinder onto the pre-stacker cylinder (FIG. 6). After 360° of rotation (just before the row of ports A again reaches the nip 111), the vacuum supply to the row of ports A is disconnected, because the row passes over the vane 124 separating the vacuum chamber t2 from the succeeding air chamber t3 (FIG. 7). Because the pre-stacker cylinder has an odd number of rows of suction ports in a given band s, the row of ports D on the second transfer cylinder that has advanced to the nip 111 is an alternate row of the type that has a passage 103*a* communicating with a vacuum chamber p1 when the row D is at the nip. The sheet B is therefore gripped by the row D of vacuum ports on the second transfer cylinder 62 as it is released from the pre-stacker cylinder. The row of vacuum ports D that grips the released sheet B already holds a sheet E. Each sheet replaced on the second transfer cylinder by the pre-stacker cylinder is placed on top of a sheet that is not removed by the pre-stacker cylinder, providing pre-stacked pairs 129 of sheets.

Figure 8:
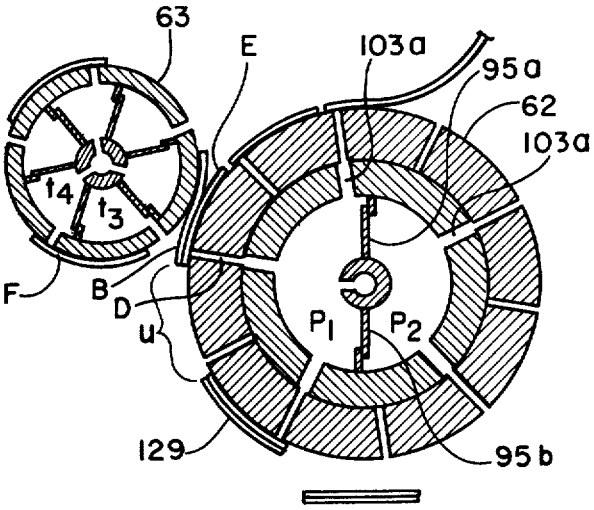
Figure 9:
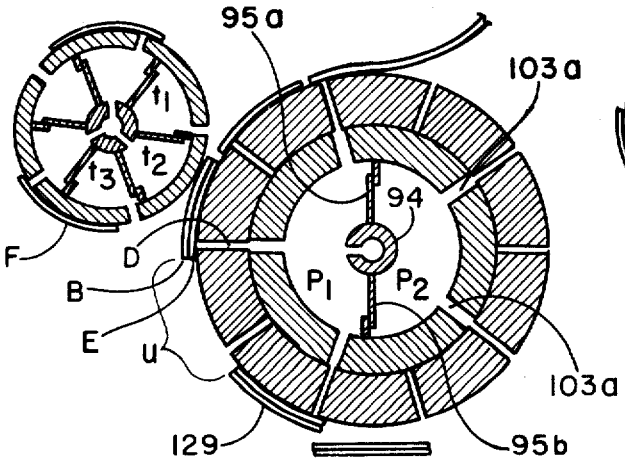
Figure 10:
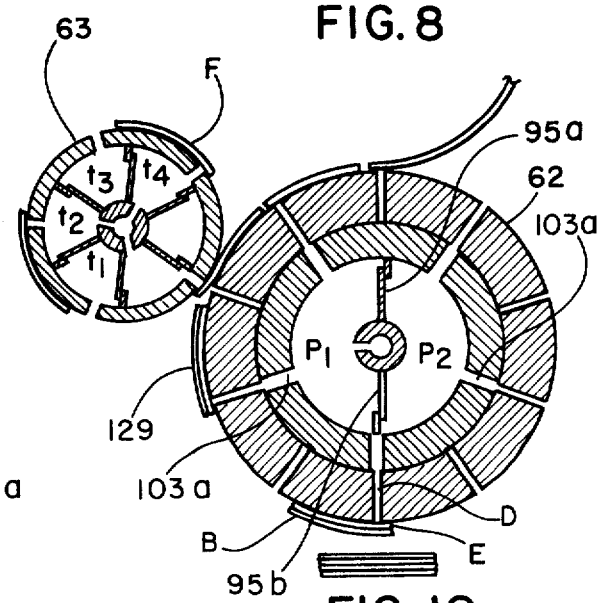

As shown in FIG. 7, the sheet F that was ahead of the sheet E remaining on the second transfer cylinder was removed by the pre-stacker cylinder, therefore the pre-stackedpair of sheets (B, E) travel downstream on the second transfer cylinder with a gap u ahead of them corresponding to the space vacated by the removed sheet F (see FIG. 8). Downstream from the nip 111 with the pre-stacker cylinder 63, the second transfer cylinder 62 carries only pre-stacked pairs 129 of sheets, in spaced relation, as shown in FIGS. 7–10.

In high speed operation of the machine, the tailing edges of sets of pre-stacked sheets 129 are carried against the second transfer cylinder, even though only their leading edges are held by a row of suction ports 90. If desired, however, a guide 149 (see FIG. 1) can be placed downstream from the pre-stacker cylinder 63 to assure that tailing edges of the sheets do not fall out of place while the sheets are being carried to the final stacking station 150.

STACKING STATION

At the stacking station 150 the sheets that were pre-stacked and spaced apart in the transfer and pre-stacking station 60 are deposited in stacks 151 at a high rate of speed. In keeping with the invention, all sheets deposited in a given stack are segments that were cut from the same folded web 33 and transferred to the stacking station 150 in the same continuous stream. The stacking operation is carried out simultaneously for each stream. Thus, a plurality of stacks 151, equal in number to the number of folded webs 33, are formed simultaneously. In the illustrative machine these stacks are formed at locations spaced axially, one after the other, along the underside of the second rotary transfer cylinder 62 (See FIG. 2). Only one of these locations 152 is illustrated, however, in FIG. 2.

As each pre-stacked pair of sheets 129 on the second rotary transfer cylinder reaches the stacking station 150, the vacuum supply to the row of suction ports 90 that theretofore gripped the pair on the second transfer cylinder is disconnected, because the passages 103*a* that connect the ports to vacuum pass from being over a vacuum chamber p1 to being over an air chamber p2 as they pass the vane 95*b* at the 6 o'clock position. The sets of pre-stacked sheets 129 are therefore released to a counter-stacker mechanism, illustrated in FIG. 2 and in FIGS. 11–20.

The counter-stacker mechanism includes four main components: an orbital packer 153, stack separator fingers 155, a stacker elevator 157, and an outfeed pusher 159.

Figure 11:
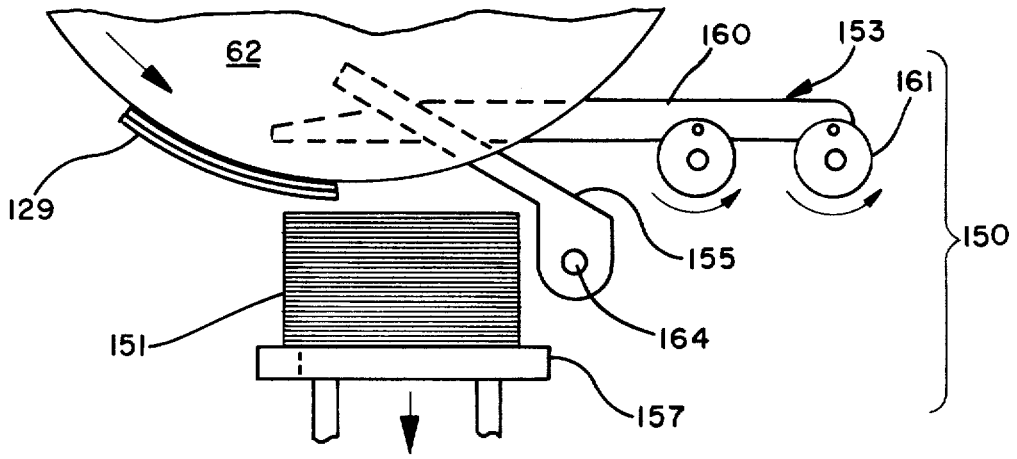
FIGS. 11 and 12 are diagrammatic illustrations of the stacking station of the machine shown in FIG. 1, showing the operation of the conventional stacking mechanism to remove sheets from the rotary transfer cylinder and place them on the top of the stack.
Figure 12:
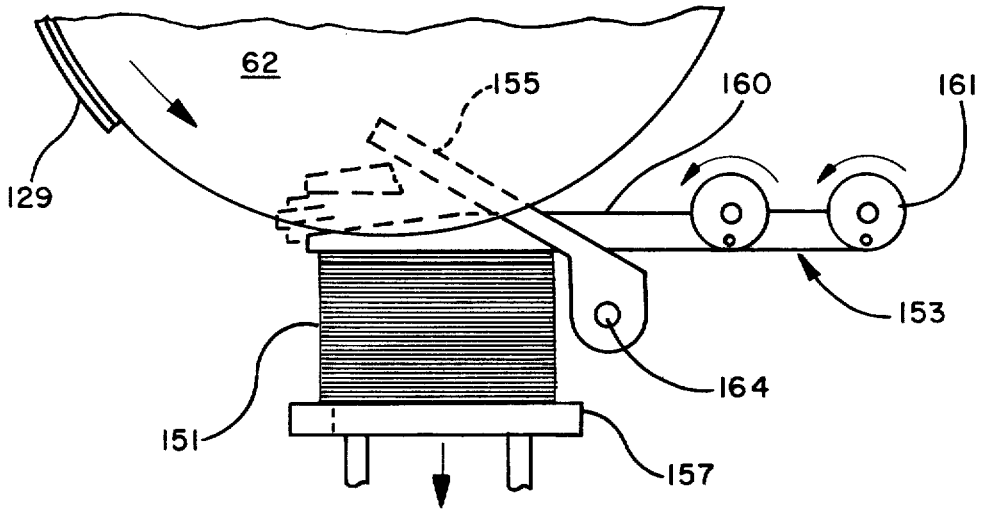

The function of the orbital packer 153 is to assist in removing sets of pre-stacked sheets 129 from the second rotary transfer cylinder 62 as they are delivered at the stacking station 150 and to pack the sheets into stacks 151. The orbital packer 153 is comprised of thin fingers 160 cantilevered from a mounting 161. The fingers are mounted with their thin section in the vertical plane with the top and bottom edges parallel and always horizontal. Four of these fingers 160 are used to pack the sheets onto each stack 151 of sheets. All points on the packer fingers move in circular paths of equal diameter in a vertical plane. The fingers are recessed into the deep grooves 84 of the second transfer cylinder 62 during about 180° of the fingers' motion (FIG. 11). During the other 180° of the motion the bottom edge of each finger protrudes beyond the bottom of the cylinder (FIG. 12). The top edge of each finger 160 always remains recessed into the deep grooves 84 to stabilize and guide the fingers. The cycle of the fingers is timed so that the second transfer cylinder delivers pre-stacked pair of sheets 129 during the 180° that the fingers are retracted into the grooves. As the fingers descend from the grooves in the second 180° of the cycle, the fingers engage the set of sheets, separate them from the cylinder, and press them downward onto the stack 151 forming beneath. Then the fingers are retracted back into the grooves, and the cycle is repeated in a regular periodic fashion.

After the orbital packer 153 has completed an arbitrary predetermined number of cycles, a stack 151 is complete, and the stack elevator 157, which has been slowly descending at a rate corresponding to the rate at which the height of the stack is increasing, begins a more rapid descent to an outfeed conveyor 163. When the elevator reaches the elevation of the conveyor surface, the outfeed pusher 159 (see FIG. 2) discharges the tissue stacks.

Figure 13:
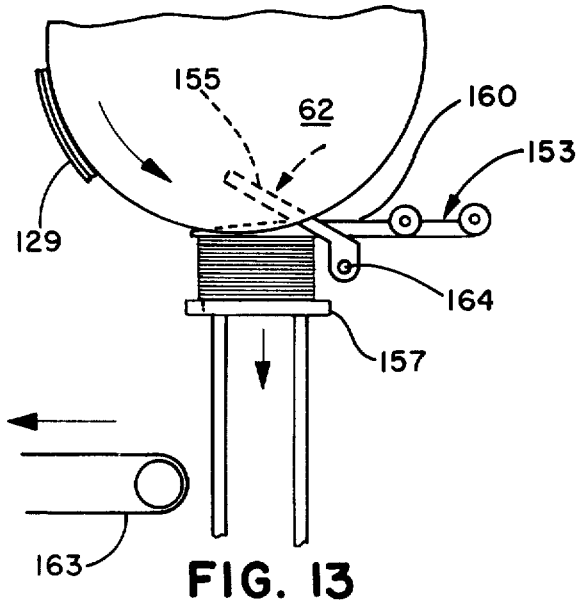
FIGS. 13–20 are diagrammatic illustrations showing the transfer of a completed stack of sheets from the stacking station to an out-feed conveyor.
Figure 14:
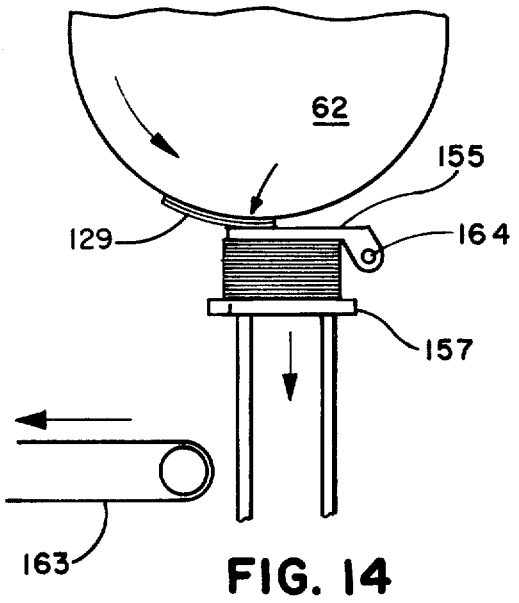
Figure 15:
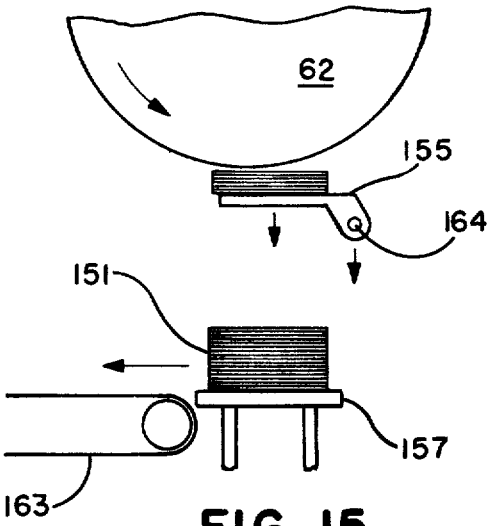
Figure 16:
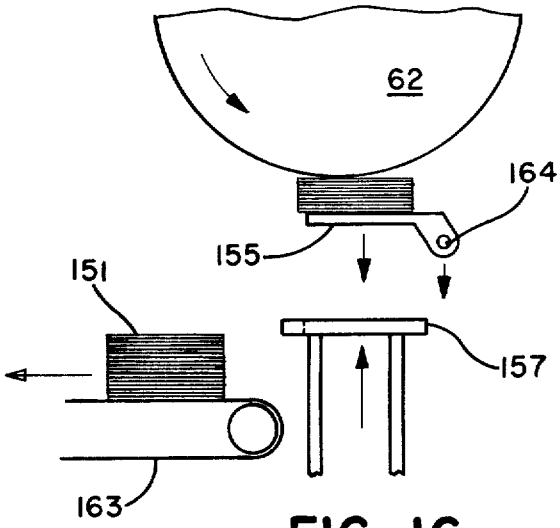

The function of the stack separator fingers 155 is to provide a platform for the continued stacking of sheets while the stack elevator 157 is moving to or from the outfeed conveyor. The stack separator fingers 155 are thin fingers mounted with their thin section in the vertical plane. The fingers are cantilevered from a mounting 164 at one end. Near the completion of a stack, the separator fingers are recessed inside the grooves 84 of the second transfer cylinder, with the top and bottom edges approximately 30° above the horizontal (FIG. 13). As the orbital packer 153 strips the last pair of sheets 129 for a stack from the second transfer cylinder 62, the stack separator fingers 155 rotate about their mounting 164 to the horizontal position, where they come to rest on the completed stack (FIG. 14). The next pair of sheets 129 packed by the orbital packer 153 are deposited on the separator fingers 155. The fingers separate the sheets of a completed stack from a new stack.

Figure 17:
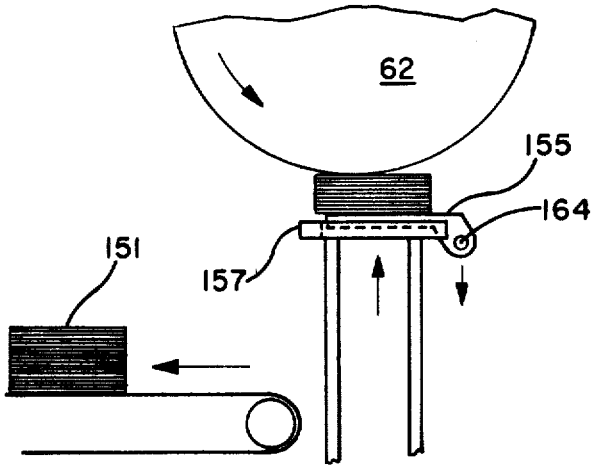
Figure 18:
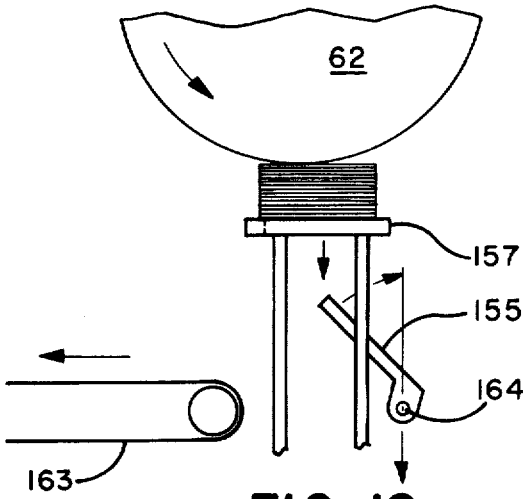
Figure 19:
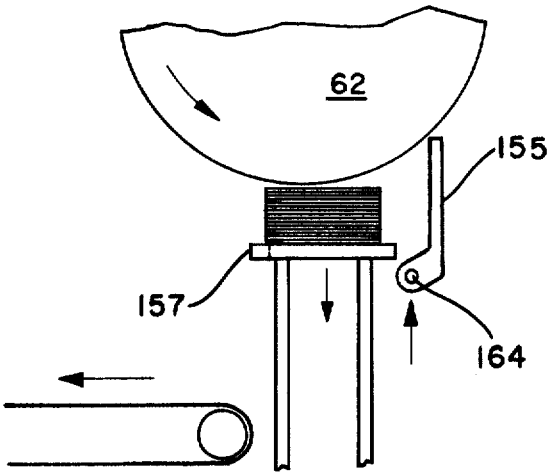
Figure 20:
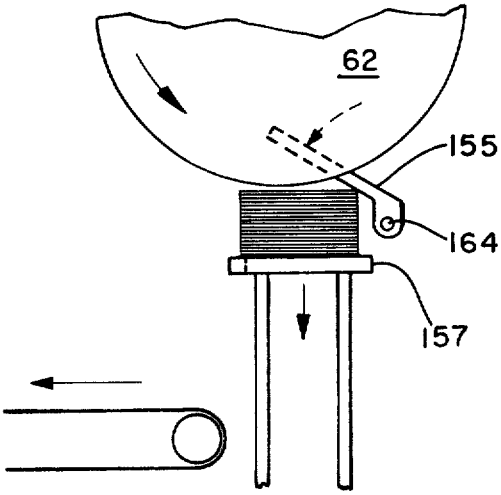

The mounting 164 of the stack separator fingers 155 is attached to a carriage, which at this point in the cycle begins a slow vertical descent. The rate of the descent is again equal to the rate at which the height of the stack is increasing. During this slow descent, the stack elevator 157 is completing its descent (FIGS. 15, 16), and after the previous stack has been discharged on the outfeed conveyor 163, the elevator 157 rises until its top surface is at the elevation of the top edge of the separator fingers 155 (FIG. 17). Slots 165 (See FIG. 2) in the top surface of the elevator allow the elevator and the separator fingers 155 to pass one another vertically without interference. The bottom of the forming stack is then supported by the elevator, which again descends at the slow rate corresponding the rate at which the height of the stack is increasing. At this point in the cycle, the separator fingers 155 return to their starting position. To do this the separator fingers are lowered until sufficient clearance is gained for the fingers to be rotated into a vertical position (FIG. 18). Then the fingers are raised until they clear the newly forming stack (FIG. 19). Finally, the separator fingers are returned to their original orientation of 30° above the horizontal within the grooves of the third conveyor cylinder (FIG. 20).

Thus, as has been seen, the present invention provides an extremely high speed machine for converting rolls of paper web into stacks of individual folded sheets. It has been found that a machine constructed in accordance with the invention is capable of carrying out the converting and stacking operations on a continuous production basis at a rate of at least 900 sheets/stack/minute. The invention increases the effective rate of stacking by the stacking mechanism used in the conversion machine, and provides the stacking mechanism with an increased interval for carrying out the stacking operation.

I claim:

1. In apparatus for converting a continuous paper web into stacks of individual web segments, the combination comprising:

a cutting station including a cutter for transversely segmenting said web into a continuous stream of adjacent sheets of regular length as said web is carried through said cutting station;

means including a rotary transfer cylinder for receiving said stream of adjacent sheets and transferring said sheets from said cutting station to a final stacking station;

a rotary pre-stacker cylinder positioned parallel and tangent to said transfer cylinder for pre-stacking sets of sheets on said transfer cylinder before said sheets are delivered to said final stacking station, including means for removing certain sheets from said transfer cylinder, carrying them through 360° of rotation, and placing them upon remaining sheets on said transfer cylinder, whereby sets of pre-stacked sheets, spaced by the gaps vacated by the removed sheets, are delivered by said transfer cylinder to said final stacking station; and means at said final stacking station for stacking said sets of pre-stacked sheets as they are delivered to said stacking station, said gaps providing an interval for stacking of one set of pre-stacked sheets onto the top of said stack, before the next set is delivered.

2. In apparatus for converting a continuous paper web into stacks of individual folded tissues, the combination comprising:

means for longitudinally folding said web;

a cutting station including a cutter for transversely cutting said folded web into a continuous series of adjacent tissues of regular length as the web is carried through said cutting station;

means including a rotary transfer cylinder for receiving said stream of adjacent tissues and transferring said tissues from said cutting station to a final stacking station;

a rotary pre-stacker cylinder positioned parallel and tangent to said transfer cylinder, said pre-stacker cylinder having (a) suction ports at regularly spaced locations around its periphery;

(b) a vacuum supply for said suction ports, and (c) means operative as the pre-stacker cylinder rotates to connect and disconnect said vacuum supply with said suction ports for removing certain of said tissues from said transfer cylinder at the nip between said cylinders, carrying said removed tissues on said pre-stacker cylinder as it rotates, releasing said removed tissues from the pre-stacker cylinder just prior to completing 360° of rotation on said pre-stacker cylinder, and placing said removed tissues onto tissues remaining on the transfer cylinder, so that said transfer cylinder delivers sets of pre-stacked tissues, with gaps between said sets, to said final stacking station;

and means for removing said pre-stacked sets of tissues from said transfer cylinder and stacking them as they are delivered at said final stacking station, said gaps providing an interval for stacking of one set of pre-stacked tissues on to the top of the stack before the next set is delivered.

3. In apparatus for converting a continuous paper web into stacks of individual web segments, the combination comprising:

a cutting station including a cutter for transversely cutting said web into web segments of regular length as said web is carried through said cutting staion;

means including a rotary transfer cylinder for carrying said web segments from said cutting station to a final stacking station;

a rotary pre-stacker cylinder for pre-stacking sets of web segments on said transfer cylinder, said pre-stacker cylinder including (a) a rotatable cylindrical shell having an odd number (N) of sets of suction ports penetrating the shell and spaced regularly around the shell a distance of at least the length of a segment;

(b) a rotor rotatably mounted within said shell and having N+1 veins in substantial sealing engagement with said shell and defining an even number N+1 of alternating vacuum and air chambers between adjacent veins and said shell, (c) a shaft for the rotor having passages communicating with said vacuum chambers and connecting said vacuum chambers to a vacuum supply, (d) means for rotating said shell and said rotor shaft in the same direction so that the rotational speed of said shell is greater than the rotational speed of said rotor by the factor (N+1)/N, whereby said suction ports communicate with successive chambers as the rotor and shell rotate, and each set of suction ports advances from being over a vacuum chamber when at the nip between said cylinders to being over the succeeding air chamber just prior to completing 360° of rotation of said shell, for removing alternate segments from said transfer cylinder as said alternate segments reach the nip, carrying said segments on the pre-stacker cylinder through 360° of rotation, and releasing the segments onto web segments remaining on the transfer cylinder, so that said transfer cylinder delivers sets of pre-stacked web segments with gaps between said sets to said final stacking station; and means for removing said sets of web segments from said transfer cylinder and stacking them as they are delivered at said final stacking station, said gaps providing an interval for stacking of one set of pre-stacked segments by the stacking means on to the top of the stack, before the next set is delivered.

4. A pre-stacking mechanism for processing a continuous stream of substantially adjacent sheets of uniform size as the sheets are carried on a moving surface from a first station to a second station, comprising a rotary cylinder that is positioned intermediate of said stations, tangent to said surface, and perpendicular including (a) a rotatable cylindrical shell having an odd number N of sets of suction ports penetrating the shell and spaced regularly around the shell a distance of at least the length of a segment;

(b) a rotor rotatably mounted within said shell and having N+1 veins in substantial sealing engagement with said shell and defining an even number N+1 of alternating vacuum and air chambers between adjacent veins and said shell, (c) a shaft for the rotor having passages communicating with said vacuum chambers and connecting said vacuum chambers to a vacuum supply, (d) means for rotating said shell and said rotor shaft in the same direction so that the rotational speed of said shell is greater than the rotational speed of said rotor by the factor (N+1)/N, whereby said suction ports communicate with successive chambers as the rotor and shell rotate, and each set of suction ports advances from being over a vacuum chamber when at the nip between said cylinder and said surface to being over the succeeding air chamber just prior to completing 360° of rotation of said shell, for removing alternate sheets from said surface as said alternate sheets reach said nip, carrying said removed sheets on said cylinder through 360° of rotation, and releasing said removed sheets onto sheets remaining on said surface, so that said surface delivers sets of pre-stacked sheets with gaps between said sets to said second station.

* * * * *